US012799942B2

(12) United States Patent
Jung et al.

(10) Patent No.: US 12,799,942 B2
(45) Date of Patent: Nov. 17, 2026

(54) MECHANICAL REVERSE ROTATION PREVENTION DEVICE FOR CANNED MOTOR PUMP

(71) Applicant: HYOSUNG GOODSPRINGS, INC., Seoul (KR)

(72) Inventors: Jae Won Jung, Changwon-si (KR); Hyeong Hoon Kim, Busan (KR); Jong Bum Kim, Gimhae-si (KR); Hyeon Sig Kim, Changwon-si (KR)

(73) Assignee: HYOSUNG GOODSPRINGS, INC., Seoul (KR)

( * ) Notice: Subject to any disclaimer, the term of this patent is extended or adjusted under 35 U.S.C. 154(b) by 0 days.

(21) Appl. No.: 19/447,992

(22) Filed: Jan. 13, 2026

(65) Prior Publication Data

US 2026/0201887 A1 Jul. 16, 2026

(30) Foreign Application Priority Data

Jan. 14, 2025 (KR) ..... 10-2025-0005111

(51) Int. Cl.
*F04D 13/06* (2006.01)
*F04D 15/02* (2006.01)

(52) U.S. Cl.
CPC ..... *F04D 13/0613* (2013.01); *F04D 15/0272* (2013.01)

(58) Field of Classification Search
CPC .... F04D 13/0613; F04D 15/0272; F04D 1/00; F04D 13/10; F04D 27/0292; F04D 29/041; F04D 29/628; F04D 15/0077; F04D 13/021; E21B 43/128; F16D 41/067; F16D 41/066; F05D 2260/4023; F05D 2260/403
USPC ..... 417/356, 423.3
See application file for complete search history.

(56) References Cited

FOREIGN PATENT DOCUMENTS

KR 10-1580526 B1 12/2015

*Primary Examiner* — Mark A Laurenzi
*Assistant Examiner* — Benjamin Doyle
(74) *Attorney, Agent, or Firm* — Revolution IP, PLLC

(57) ABSTRACT

A reverse rotation prevention device for a canned motor pump includes: a rotor 110 rotating together with a main shaft of a motor; a stator 120 provided to be spaced at a first distance apart from an outer peripheral surface of the rotor 110; a plurality of hinges 130 arranged parallel to the main shaft, positioned between the outer peripheral surface of the rotor 110 and an inner peripheral surface of the stator 120, and placed at a preset interval on a circumference spaced a second distance apart from the outer peripheral surface of the rotor 110, the second distance being half the first distance; and a plurality of wedges 140 rotatably connected to the plurality of hinges 130, and rotating in one direction due to centrifugal force according to a flow direction of fluid F provided in a space formed between the rotor 110 and the stator 120.

3 Claims, 6 Drawing Sheets

MECHANICAL REVERSE ROTATION PREVENTION DEVICE FOR CANNED MOTOR PUMP

CROSS-REFERENCE TO RELATED APPLICATION

This application claims the benefit of and priority to Korean Patent Application No. 10-2025-0005111 filed on Jan. 14, 2025, the entire disclosure(s) of which is hereby incorporated herein by reference in its entirety.

BACKGROUND

The present disclosure relates to a mechanical reverse rotation prevention device for a canned motor pump, and more specifically, to a mechanical reverse rotation prevention device for a canned motor pump, which does not require an external power supply or lubricating oil supply and operates stably without any additional auxiliary devices.

This work was supported by the Innovative Small Modular Reactor Development Agency grant funded by the Korea Government (MSIT) (No. RS-2023-00264749).

In general, a system composed of a motor and a pump employs a method in which the motor and pump are connected by coupling to drive the pump. At this point, a reverse rotation prevention device is mainly installed in the form of a ball bearing on the motor side. The ball-bearing type reverse rotation prevention device needs an external lubricating oil supply and requires periodic replacement as the device wears out. Therefore, maintenance and management are essential for such a bearing-type reverse rotation prevention device.

A canned motor pump has a structure in which a motor and pump are integrally combined as one unit. The major feature is that there is no leakage due to the absence of a shaft. For this reason, the canned motor pump is mainly used in situations where liquids containing radiation or hazardous liquids are handled, which are dangerous if exposed to the outside. The canned motor pump may ensure high safety in such environments.

However, due to the structural characteristics of the canned motor pump, there is a problem in that lubricating oil or bearing oil cannot be supplied from the outside. The existing ball-bearing type reverse rotation prevention device is not suitable for such a system and have limitations in application to a canned motor pump. The ball-bearing type reverse rotation prevention device requires periodic maintenance due to lubricating oil supply and wear, but the canned motor pump is not capable of such maintenance.

Korean Patent No. 10-1580526, which is proposed as one of the existing technologies, discloses an actuator-type reverse rotation prevention device. However, this method requires electrical energy, and there is a problem that the device may not work if a power supply is interrupted in an accident situation. In addition, because the electrical energy is used, auxiliary devices such as a sensor to check the direction of rotation, a power supply, and cables are required. These auxiliary devices require separate management and maintenance, which may complicate the system.

Therefore, existing technologies have several problems due to external lubricant supply issues and dependence on electric energy. To solve such problems, research is required on a mechanical reverse rotation prevention device for a canned motor pump that does not require an external power supply or lubricating oil supply and operates stably without any auxiliary devices.

PRIOR LITERATURE

Patent Literature (Patent Literature 1) Korean Patent No. 10-1580526

SUMMARY

In view of the above, the present disclosure provides a mechanical reverse rotation prevention device applicable to a canned motor pump, the device in which an external lubricating oil supply is unnecessary and a motor and a pump are integrally combined as one unit.

The present disclosure also provides a reverse rotation prevention device that does not use electric energy and is capable of operating stably even when a power supply is interrupted.

In addition, the present disclosure provides a mechanical reverse rotation prevention device that fixes each wedge to a rotor during reverse rotation using permanent magnets, and maintains a constant gap during normal rotation so that fluid may flow smoothly.

The present disclosure also provides a mechanical reverse rotation prevention device for a canned motor pump, the device which is capable of detecting wear and status changes in real time to ensure performance without any external auxiliary devices or maintenance and management.

A mechanical reverse rotation prevention device for a canned motor pump according to one embodiment of the present disclosure includes: a rotor 110 rotating together with a main shaft of a motor; a stator 120 provided to be spaced at a first distance apart from an outer peripheral surface of the rotor 110; a plurality of hinges 130 arranged parallel to the main shaft, positioned between the outer peripheral surface of the rotor 110 and an inner peripheral surface of the stator 120, and arranged at a preset interval on a circumference spaced a second distance apart from the outer peripheral surface of the rotor 110, the second distance being half the first distance; and a plurality of wedges 140 rotatably connected to the plurality of hinges 130, and rotating in one direction due to centrifugal force according to a flow direction of fluid F provided in a space formed between the rotor 110 and the stator 120, wherein during normal rotation, a gap D is formed between each of plurality of wedges 140 and the rotor 110 so that fluid F passes therethrough, and during reverse rotation, one end of each of the plurality of wedges 140 returns to a position where to contact the outer peripheral surface of the rotor 110, while the other end of the corresponding one of the plurality of wedges 140 contacts the inner peripheral surface of the stator 120, thereby eliminating the gap D to limit the reverse rotation of the rotor 110.

In addition, the plurality of wedges 140 according to one embodiment of the present disclosure may have a longest distance in a cross-section taken along in a direction perpendicular to the plurality of hinges 130 longer than the first distance, and a tolerance of the plurality of wedges may be larger than a tolerance of the stator.

In addition, permanent magnets 150 may be included in the plurality of wedges 140 and the rotor 110 according to one embodiment of the present disclosure, wherein the permanent magnets 150 may be configured to: maintain the gap D by rotating each wedge 140 in one direction about a corresponding hinge 130 using a repulsive force between same poles (N-pole-N-pole) of the wedge 140 and the rotor 110 during normal rotation; and eliminate the gap D by rotating each wedge 140 in an opposite direction about the corresponding hinge 130 using a repulsive force between same poles (S-pole-S-pole) during reverse rotation, thereby allowing the wedge 140 to be in contact with the rotor 110, wherein the permanent magnets 150 may be sealed, and the plurality of wedges 140 and the rotor 110 may be made of a non-magnetic material.

In addition, the reverse rotation prevention device according to one embodiment of the present disclosure may further include a sensor unit for monitoring a status of the plurality of wedges 140 and the rotor 110, wherein the sensor unit measures a rotational angle of each of the plurality of wedges 140 and a rotational speed of the rotor 110, and detects wear and status changes through comparison with a preset normal operating state, wherein the status change is configured to generate a warning signal based on a wear threshold value Mth, wherein the wear threshold value Mth is determined based on a wear index M calculated according to the following [Equation 1], wherein the warning signal is generated when the M exceeds the threshold value Mth.

$$M = \Delta\theta \times k_1 + \Delta v \times k_2 \quad \text{[Equation 1]}$$

Where M denotes a wear index, $\Delta\theta$ denotes a change in rotational angle of each of the plurality of wedges 140, $\Delta v$ denotes a change in speed of the rotor 110, and $k_1$ and $k_2$ denote correction factors for respective variables.

A mechanical reverse rotation prevention device for a canned motor pump according to one embodiment of the present disclosure has the advantage of being applicable to a canned motor pump in which a motor and a pump are integrally combined as one unit without an external lubricating oil supply.

In addition, the mechanical reverse rotation prevention device, according to one embodiment of the present disclosure, has the advantage of not using electric energy while operating stably even when a power supply is interrupted.

In addition, the reverse rotation prevention device, according to one embodiment of the present disclosure, has the advantage of fixing each wedge to a rotor during reverse rotation using permanent magnets, and maintaining a constant gap during normal rotation so that fluid may flow smoothly.

In addition, the mechanical reverse rotation prevention device for the canned motor pump, according to one embodiment of the present disclosure, has the advantage of ensuring performance by detecting a wear status and changes of the device in real-time without any external auxiliary devices or without maintenance and management.

DETAILED DESCRIPTION

Hereinafter, specific embodiments of the present disclosure will be described in detail with reference to the drawings. However, the spirit of the present disclosure is not limited to the embodiments presented herein, and those skilled in the art, understanding the spirit of the present disclosure, may readily propose other embodiments that fall within the same scope of the present disclosure by adding, modifying, or deleting components, or through other retrogressive inventions, and such embodiments shall also be considered within the scope of the present disclosure.

Hereinafter, a mechanical reverse rotation prevention device 100 for a canned motor pump of the present disclosure will be described in detail with reference to the accompanying drawings FIGS. 1 to 6.

Figure 1:
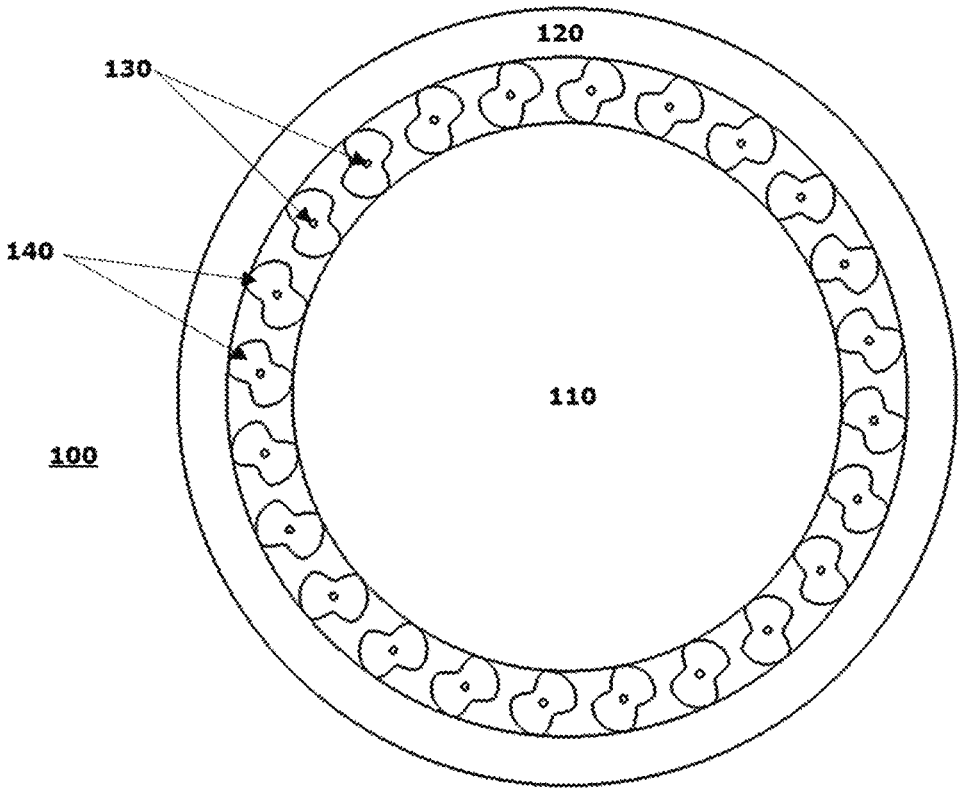
FIG. 1 is a cross-sectional view showing a mechanical reverse rotation prevention device for a canned motor pump according to one embodiment of the present disclosure.
Figure 2:
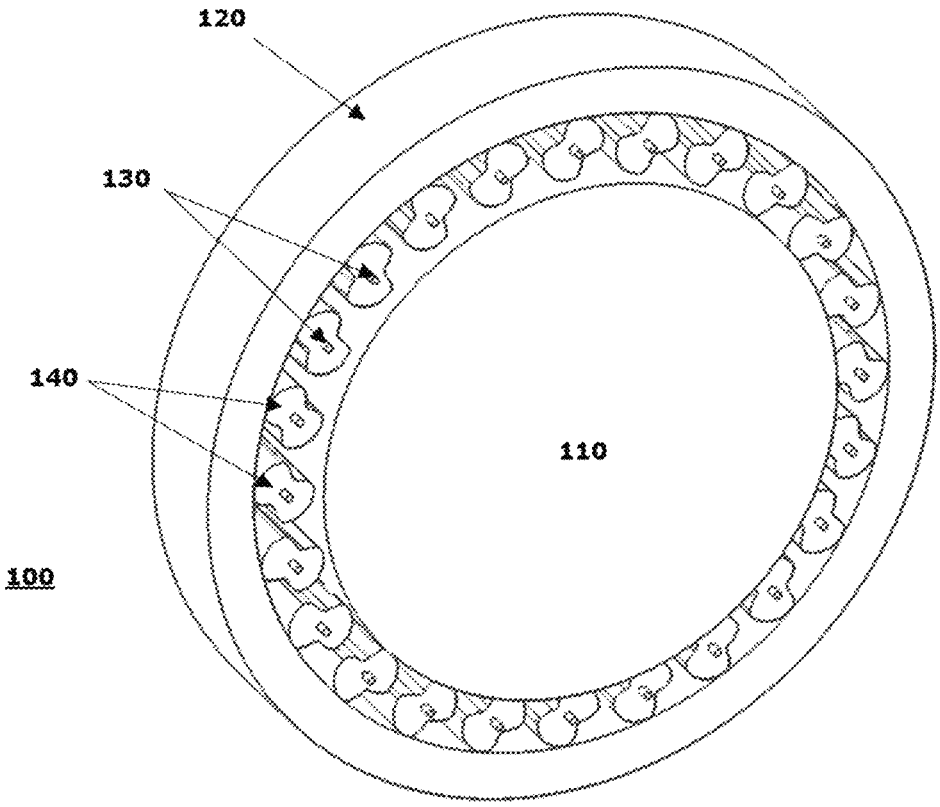
FIG. 2 is a cross-sectional perspective view showing a mechanical reverse rotation prevention device for a canned motor pump according to one embodiment of the present disclosure.
Figure 3:
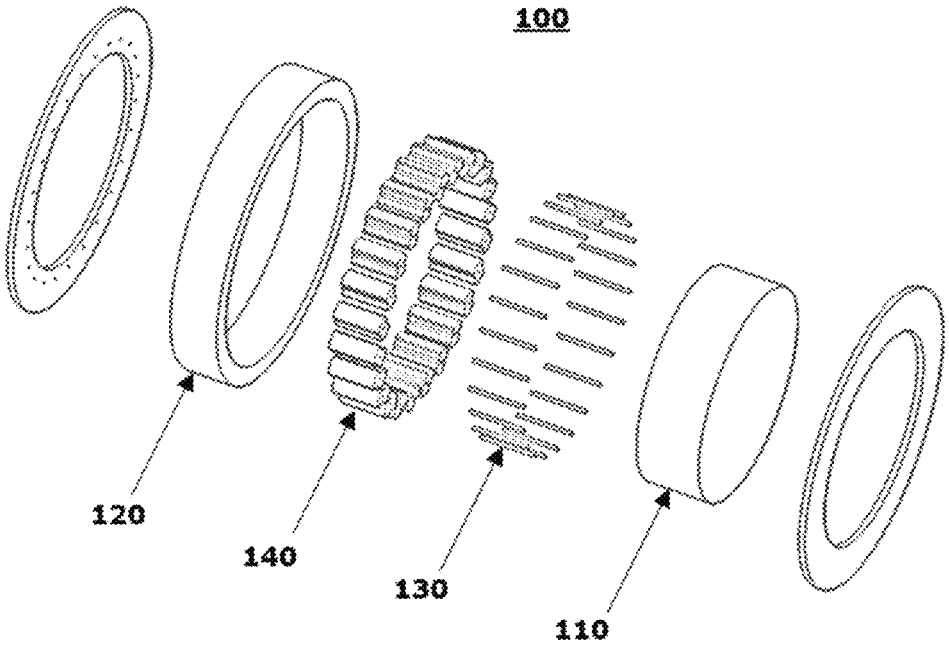
FIG. 3 is an exploded view of a mechanical reverse rotation prevention device for a canned motor pump according to one embodiment of the present disclosure.
Figure 4:
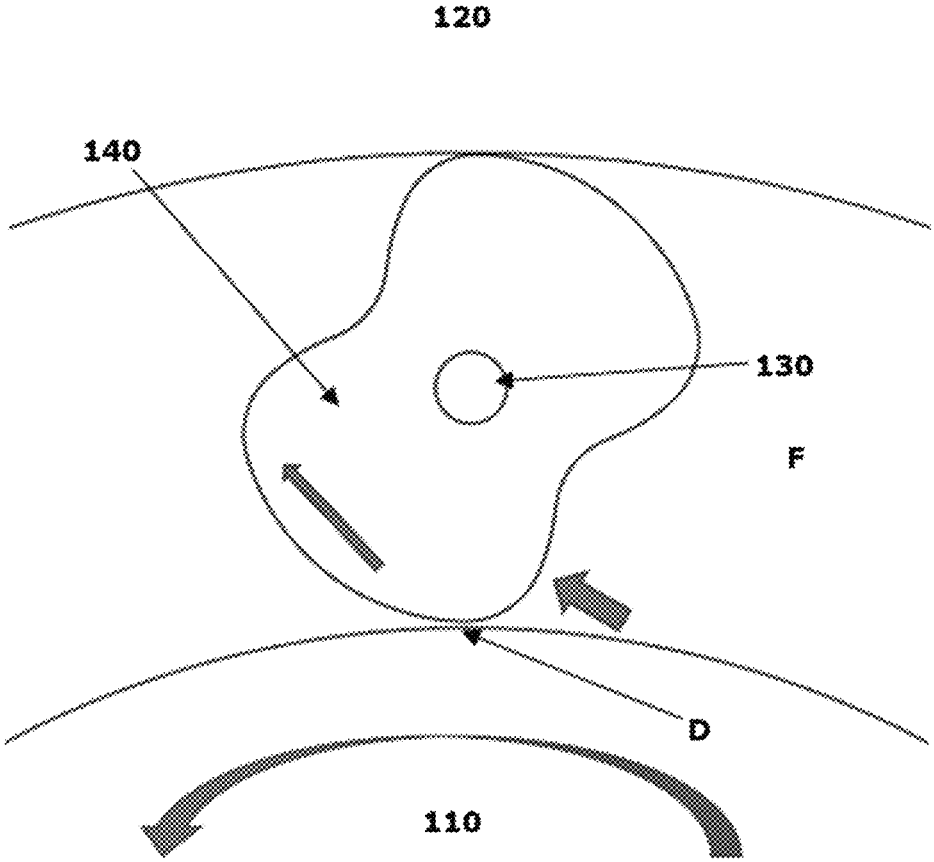
FIG. 4 is a cross-sectional view showing a mechanical reverse rotation prevention device of a forward-rotating canned motor pump according to one embodiment of the present disclosure.

FIG. 1 is a cross-sectional view showing a mechanical reverse rotation prevention device for a canned motor pump according to one embodiment of the present disclosure; FIG. 2 is a cross-sectional perspective view showing a mechanical reverse rotation prevention device for a canned motor pump according to one embodiment of the present disclosure; FIG. 3 is an exploded view of a mechanical reverse rotation prevention device for a canned motor pump according to one embodiment of the present disclosure; and FIG. 4 is a cross-sectional view showing a mechanical reverse rotation prevention device of a forward-rotating canned motor pump according to one embodiment of the present disclosure.

Referring to FIGS. 1 to 4, the reverse rotation prevention device 100 according to one embodiment of the present disclosure may include a rotor 110, a stator 120, a plurality of hinges 130, and a plurality of wedges 140.

The rotor 110 may rotate together with a main shaft of a motor.

The stator 120 may be provided at a first distance from an outer peripheral surface of the rotor 110.

The plurality of hinges 130 may be arranged parallel to the main shaft, positioned between the outer peripheral surface of the rotor 110 and an inner peripheral surface of the stator 120, and placed at a preset interval on a circumference spaced a second distance, which is half the first distance, apart from the outer peripheral surface of the rotor 110. The plurality of hinges 130 is a part that connects the plurality of wedges 140 so that the plurality of wedges 140 rotates between the rotor 110 and the stator 120. The plurality of hinges 130 may each serve as a shaft that allows the plurality of wedges 140 to rotate in one direction due to centrifugal force of fluid. In addition, the plurality of hinges 130 may ensure stable operation centered on the rotation of the plurality of wedges 140. The plurality of hinge 130 may be formed of a durable material and minimize wear even during long-term use of the device.

The plurality of wedges 140 may be rotatably connected to the plurality of hinge 130 and rotate in one direction due to centrifugal force according to a flow direction of fluid F provided in a space formed between the rotor 110 and the stator 120. The plurality of wedges 140 may have a longest distance in a cross-section taken along in a direction perpendicular to the plurality of hinge 130 longer than the first distance, and the plurality of wedges 140 may be provided in a space between a pair of bearings coupled to the main shaft. Of course, the rotor 110, the stator 120, the plurality of hinges 130, and the plurality of wedges 140 may all be provided in the space between the pair of bearings. As the rotor 110, the stator 120, the plurality of hinges 130, and the plurality of wedges 140 are provided in the space between the bearings, the bearings may be aligned concentrically. The bearings may be provided as dynamic-pressure and static-pressure sleeve bearings, and a surface of each of the bearings may be treated with an overlay weld build-up coating and a DLC coating.

Additionally, a tolerance of the plurality of wedges 140 may be set to be larger than a tolerance of the bearings. Additionally, the plurality of wedges 140 may be rotatably connected to the hinge 130 to rotate in one direction according to a flow of fluid. The plurality of wedges 140 may control the flow of fluid by forming or eliminating a gap D between the rotor 110 and the stator 120 while rotating due to centrifugal force. The plurality of wedges 140 may be formed of a material with excellent wear resistance and may be designed to withstand impact and wear occurring during rotation.

In addition, during normal rotation, a gap D may be formed between each of the plurality of wedges 140 and the rotor 110 so that the fluid F passes through.

In addition, during reverse rotation, one end of each of the plurality of wedges 140 returns to a position where to contact the outer peripheral surface of the rotor 110, while the other end of the corresponding one of the plurality of wedges 140 contacts the inner peripheral surface of the stator 120, thereby eliminating the gap D to limit the reverse rotation of the rotor 110.

Next, the reverse rotation prevention device 100 including permanent magnets 150 will be described with reference to FIGS. 5 and 6.

Figure 5:
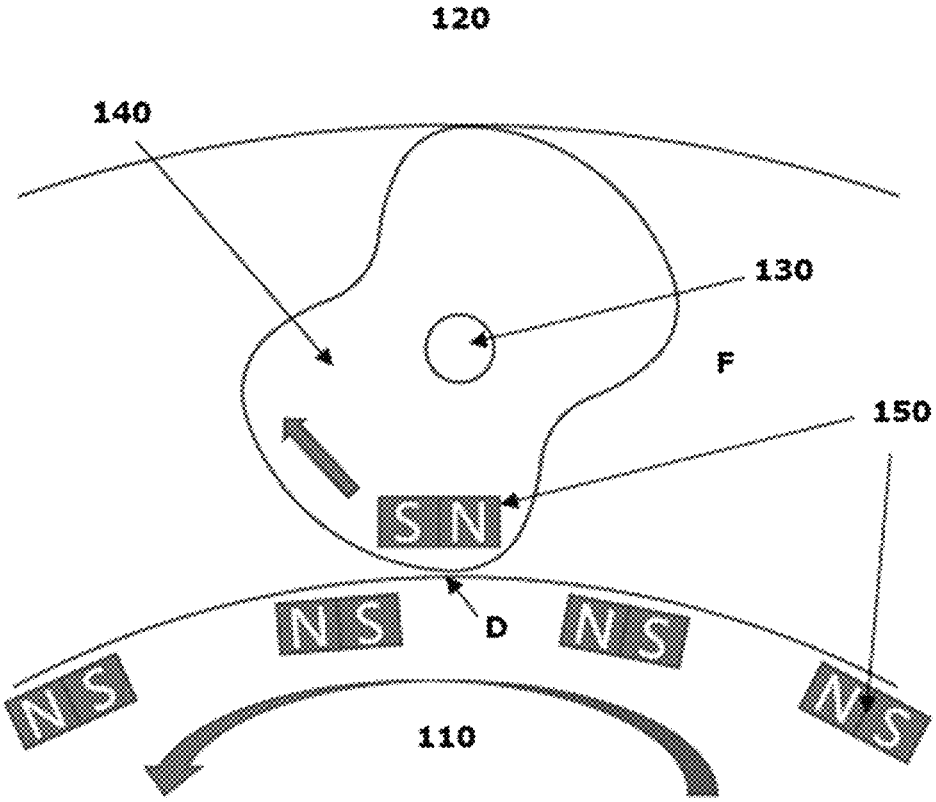
FIG. 5 is a cross-sectional view showing a mechanical reverse rotation prevention device for a forward-rotating canned motor pump including permanent magnets according to one embodiment of the present disclosure.
Figure 6:
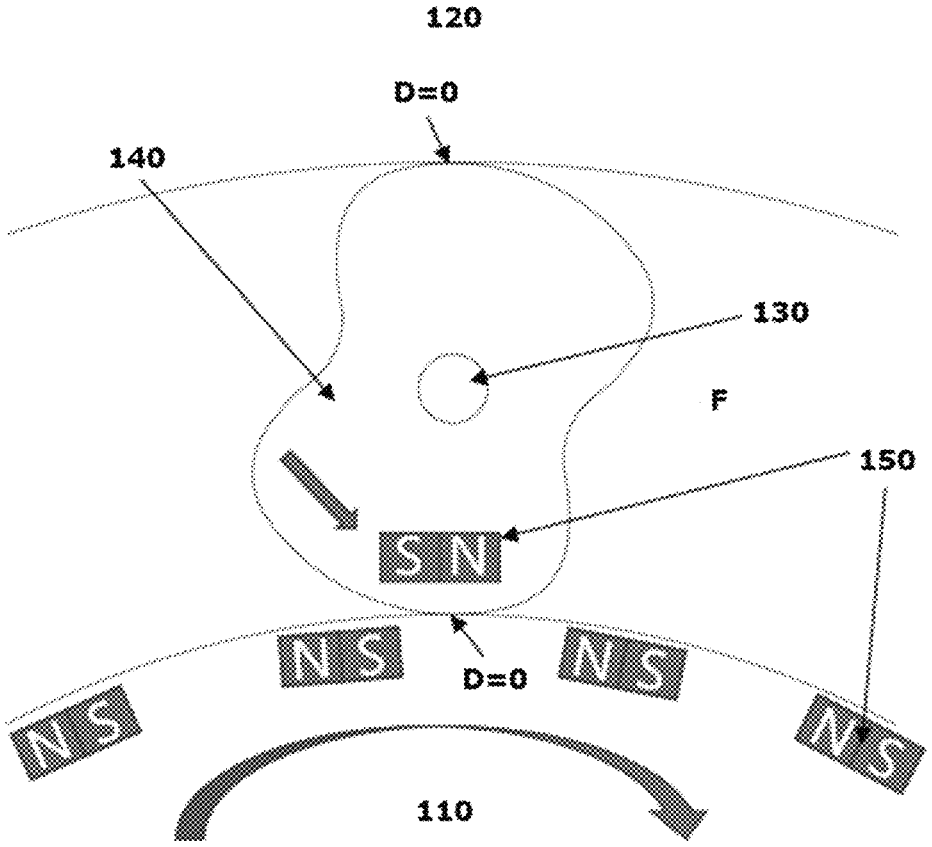
FIG. 6 is a cross-sectional view showing a mechanical reverse rotation prevention device for a reversely-rotating canned motor pump including permanent magnets according to one embodiment of the present disclosure.

FIG. 5 is a cross-sectional view showing a mechanical reverse rotation prevention device for a forward-rotating canned motor pump including permanent magnets according to one embodiment of the present disclosure, and FIG. 6 is a cross-sectional view showing a mechanical reverse rotation prevention device for a reversely-rotating canned motor pump including permanent magnets according to one embodiment of the present disclosure.

Referring to FIGS. 5 and 6, the permanent magnets 150 may be included in the wedges 140 and the rotor 110. The permanent magnets 150 may be configured to maintain the gap D by rotating each wedge 140 in one direction about a corresponding hinge 130 using a repulsive force between the same poles (N-pole-N-pole) of the wedge 140 and the rotor 110 during normal rotation, and to eliminate the gap D by rotating each wedge 140 in an opposite direction about a corresponding hinge 130 using a repulsive force between the same poles (S-pole-S-pole) during reverse rotation, thereby allowing the wedge 140 to be in contact with the rotor 110 and preventing reverse rotation. In addition, the permanent magnets 150 may be sealed, and the wedges 140 and the rotor 110 may be made of a non-magnetic material. The permanent magnets 150 may be included in the wedges 140 and the rotor 110 to control rotation of each wedge. The permanent magnets 150 may be sealed with a material having excellent durability and corrosion resistance, thereby improving lifespan and stability of the device.

In addition, the permanent magnets 150 may be arranged at appropriate spacings inside and outside of the wedges 140 and the rotor 110, and may precisely control rotation of the wedges 140 according to normal rotation and reverse rotation situations. The magnets are configured to provide an accurate repulsive force between each wedge and the rotor so that the gap D may be quickly eliminated during reverse rotation without interfering with the flow of the fluid.

In addition, the permanent magnets 150 may be designed to operate stably in high-temperature and high-pressure environments, and may be subjected to a corrosion-resistant coating for corrosion prevention. This may extend the lifespan of the device and minimize maintenance needs.

The permanent magnets 150 do not require electrical energy, and thus enable the device to operate stably without external power supply. This is an important factor that allows the canned motor pump to maintain reverse rotation prevention performance even when external power is cut off.

In addition, although not shown in the drawing, the mechanical reverse rotation prevention device 100 for the canned motor pump according to one embodiment of the present disclosure may further include a sensor unit (not shown) that monitors a status of the plurality of wedges 140 and the rotor 110.

The sensor unit is characterized by measuring a rotational angle of each of the plurality of wedges 140 and a rotational speed of the rotor 110, detecting wear and a change in status by comparing measurements with a preset normal operating state, and generating a warning signal when a change in the status is detected based on a wear threshold value Mth, wherein the wear threshold value Mth is determined based on a wear index M calculated according to the following [Equation 1], wherein a warning signal is generated when the M exceeds the threshold value Mth.

$$M = \Delta\theta \times k_1 + \Delta v \times k_2 \quad \text{[Equation 1]}$$

where M denotes a wear index, $\Delta\theta$ denotes a change in rotational angle of each of the plurality of wedges 140, $\Delta v$ denotes a change in speed of the rotor 110, and $k_1$ and $k_2$ denote correction factors for respective variables.

In addition, the sensor unit may measure the rotational angle and speed in real time through precision sensors respectively placed on the plurality of wedges 140 and the rotor 110. These sensors may include optical sensors, gyroscope sensors, or Hall sensors, and may detect a minute change in the rotational angle of each of the plurality of wedges 140 and a change in the speed of the rotor 110, thereby enabling very accurate tracking of the movement and wear status of the rotor. The sensor unit may transmit measured data to a central control unit to compare and analyze the measured data with preset normal operating values and detect a change in the operating status in real time.

In addition, the sensor unit may calculate the 'predicted wear index Mpred' according to [Equation 2] based on the rotational angle change amount $\Delta\theta$ of each of the plurality of wedges 140 and a speed change amount $\Delta v$ of the rotor 110. This Equation is designed to predict the future wear condition of the device based on past data of the device as well as the current rotational status.

$$M_{pred} = (\Delta\theta \times \alpha_1) + (\Delta v \times \alpha_2) + \left(\int_0^T (M \cdot \beta)dt\right) \quad \text{[Equation 2]}$$

Here, Mpred denotes a predicted wear index, Δθ denotes a change in rotational angle of the plurality of wedges 140, Δv denotes a change in speed of the rotor 110, α1 and α2 denote correction factors for the changes in rotational angle and speed, M denotes a previously calculated wear index, β denotes a coefficient representing a rate of change of the wear index over time, and T denotes a time range to analyze.

The following [Equation 2] may be used to predict a future wear condition based on not only a current condition of the plurality of wedges 140 but also past wear data. In doing so, the sensor unit may predict wear of the plurality of wedges 140 and rotor 110 and accurately determine when proactive maintenance is needed.

The sensor unit may generate a warning signal based on this prediction data, as well as output an adjustment signal to maintain an optimal operating condition of the device. This adjustment signal may be transmitted to the central control unit and used to adjust a rotational speed of a machine or control a flow of fluid. Such features allow the device to maximize the efficiency and provide preventive maintenance to reduce wear.

In addition, the sensor unit may record all operating states and wear conditions of the device through a data logging function, and analyze long-term performance changes based on such records. This data may be linked to a cloud-based remote monitoring system, allowing users to check device status in real-time via a mobile device or computer.

As such, the sensor unit linked to the remote monitoring system may automatically plan a maintenance schedule and prepare for the replacement of necessary parts in advance before wear reaches a threshold.

The sensor unit may be protected with a durable material to operate reliably even in high-temperature and high-pressure environments and to maintain the safety of the device, especially in environments such as a canned motor pump where hazardous liquids are handled. Additionally, the sensor unit may include a function to safely store data even when power is interrupted, and to automatically recover and restart when power is recovered.

As described above, according to one embodiment of the present disclosure, the present disclosure may be applied to a canned motor pump in which a motor and a pump are integrally combined as an integral unit without an external lubricant supply, does not require electric energy, and is capable of operating stably even when a power supply is interrupted.

In addition, the reverse rotation prevention device according to one embodiment of the present disclosure fixes each wedge to a rotor during reverse rotation using permanent magnets, and maintains a constant gap during normal rotation, thereby ensuring a smooth flow of fluid.

In addition, the mechanical reverse rotation prevention device for the canned motor pump according to one embodiment of the present disclosure has the advantage of ensuring performance by detecting a wear status and changes of the device in real time without any external auxiliary devices or without maintenance and management.

Although the present disclosure has been described above with a specific embodiment and drawings, the present disclosure is not limited to the above-described embodiment, and various modifications and changes are made from this description by those skilled in the art to which the present disclosure pertains. Accordingly, the embodiments of the present disclosure should be understood only by the claims set forth below, and all equivalent modifications and variations thereof will be considered to be within the scope of the present disclosure.

DETAILED DESCRIPTION OF MAIN ELEMENTS

100: mechanical reverse rotation prevention device for canned motor pump
110: rotor
120: stator
130: hinge
140: wedge
150: permanent magnet
D: gap
F: fluid

What is claimed is:

1. A reverse rotation prevention device comprising:

a rotor rotating together with a main shaft of a motor;

a stator provided to be spaced at a first distance apart from an outer peripheral surface of the rotor;

a plurality of hinges arranged parallel to the main shaft, positioned between the outer peripheral surface of the rotor and an inner peripheral surface of the stator, and placed at a preset interval on a circumference spaced a second distance apart from the outer peripheral surface of the rotor, the second distance being half the first distance; and a plurality of wedges rotatably connected to the plurality of hinges, and rotating in one direction due to centrifugal force according to a flow direction of fluid provided in a space formed between the rotor and the stator, wherein during normal rotation, a gap is formed between each of plurality of wedges and the rotor so that fluid passes therethrough, and during reverse rotation, one end of each of the plurality of wedges returns to a position where to contact the outer peripheral surface of the rotor, while the other end of the corresponding one of the plurality of wedges contacts the inner peripheral surface of the stator, thereby eliminating the gap to limit the reverse rotation of the rotor, wherein permanent magnets are included in the plurality of wedges and the rotor, wherein permanent magnets are included in the plurality of wedges and the rotor, wherein the permanent magnets are configured to: maintain the gap by rotating each wedge in one direction about a corresponding hinge using a repulsive force between same poles (N-pole-N-pole) of the wedge and the rotor during normal rotation; and eliminate the gap by rotating each wedge in an opposite direction about the corresponding hinge using a repulsive force between same poles (S-pole-S-pole) during reverse rotation, thereby allowing the wedge to be in contact with the rotor, wherein the permanent magnets are sealed, and the plurality of wedges and the rotor are made of a non-magnetic material.

2. The reverse rotation prevention device of claim 1, wherein the plurality of wedges have a longest distance in a cross-section taken along in a direction perpendicular to the plurality of hinges longer than the first distance, wherein the plurality of wedges are provided in a space between a pair of bearings coupled to the main shaft, and wherein a tolerance of the plurality of wedges is larger than a tolerance of the bearings.

3. The reverse rotation prevention device of claim 1, wherein the reverse rotation prevention device further comprises a sensor unit for monitoring a status of the plurality of wedges and the rotor, wherein the sensor unit measures a rotational angle of each of the plurality of wedges and a rotational speed of the rotor, and detects wear and status changes through comparison with a preset normal operating state, wherein the status change is configured to generate a warning signal based on a wear threshold value Mth, wherein the wear threshold value Mth is determined based on a wear index M calculated according to the following [Equation 1], wherein the warning signal is generated when the M exceeds the threshold value Mth, $$M = \Delta\theta \times k_1 + \Delta v \times k_2 \quad \text{[Equation 1]}$$

where M denotes a wear index, $\Delta\theta$ denotes a change in rotational angle of each of the plurality of wedges, $\Delta v$ denotes a change in speed of the rotor, and $k_1$ and $k_2$ denote correction factors for respective variables.

* * * * *